US006382870B1

(12) United States Patent
Gertz

(10) Patent No.: US 6,382,870 B1
(45) Date of Patent: May 7, 2002

(54) NESTING COLLAPSIBLE BLOW-MOLDED BARRICADE

(75) Inventor: David C. Gertz, San Clemente, CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

(21) Appl. No.: 09/502,480

(22) Filed: Feb. 11, 2000

Related U.S. Application Data

(60) Provisional application No. 60/119,691, filed on Feb. 11, 1999.

(51) Int. Cl.[7] ..... E01F 9/012
(52) U.S. Cl. ..... 404/6; 404/9; 116/63 P
(58) Field of Search ..... 404/6, 9, 10; 116/63 P; 40/610; 403/113; 16/376

(56) References Cited

U.S. PATENT DOCUMENTS 2,719,506 A * 10/1955 Sequeira ..... 116/63
2,864,191 A * 12/1958 Hagen ..... 40/125
3,949,701 A 4/1976 Teixeira
3,971,331 A * 7/1976 Sawyer ..... 116/63 P
4,298,186 A 11/1981 Glass
4,624,210 A * 11/1986 Glass ..... 116/63 P
4,852,511 A * 8/1989 Look et al. ..... 116/63 P
4,859,983 A 8/1989 Kulp et al.
5,003,912 A 4/1991 Thurston
5,046,885 A * 9/1991 Thurston ..... 404/10
5,342,140 A * 8/1994 Glass ..... 404/9
5,358,762 A * 10/1994 McGrath ..... 428/12
5,458,434 A 10/1995 Bent et al.
5,544,614 A * 8/1996 Cushman ..... 116/63 P
5,570,972 A * 11/1996 Glass et al. ..... 404/6
6,101,967 A * 8/2000 Glass et al. ..... 116/63 P

* cited by examiner

*Primary Examiner*—Thomas B. Will
*Assistant Examiner*—Kristine Markovich
(74) *Attorney, Agent, or Firm*—Stout, Uxa, Buyan & Mullins, LLP; Donald E. Stout

(57) ABSTRACT

A sawhorse type of traffic barricade constructed from identical leg units. The legs are equipped with a stop to prevent them from opening beyond a predetermined point. The legs have the cross section of a right triangle, allowing the hypotenuse sides of the legs to nest within each other. The legs may be equipped with complementary convex and concave portions to allow the barricades to be stacked securely atop one another by fitting the portions together.

22 Claims, 7 Drawing Sheets

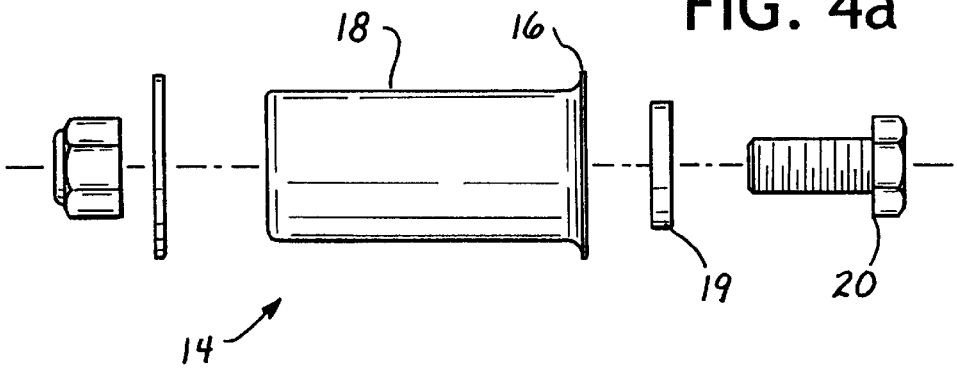
FIG. 4a
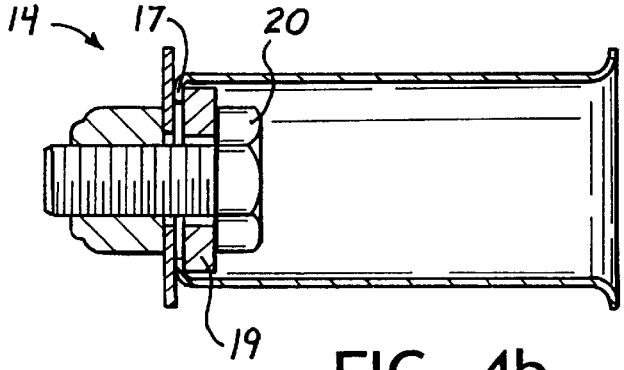
FIG. 4b
FIG. 5
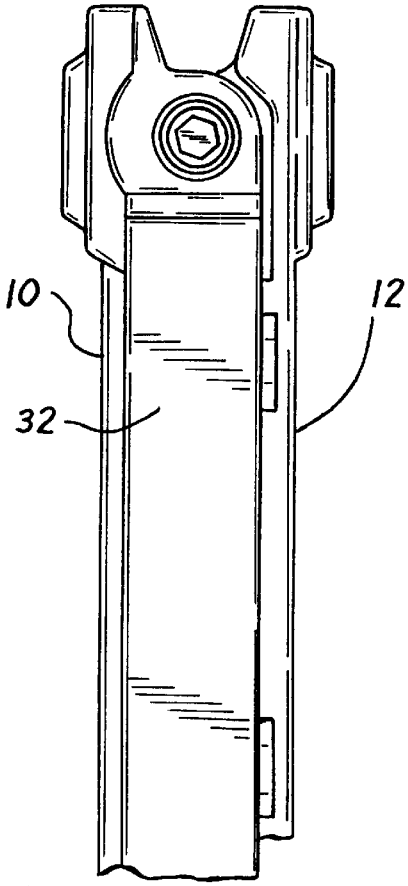
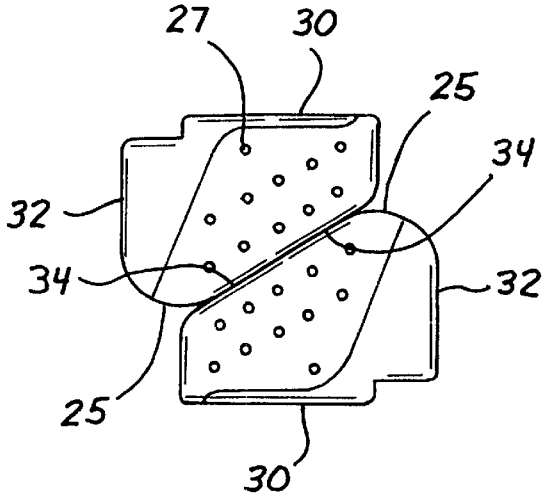
FIG. 5a

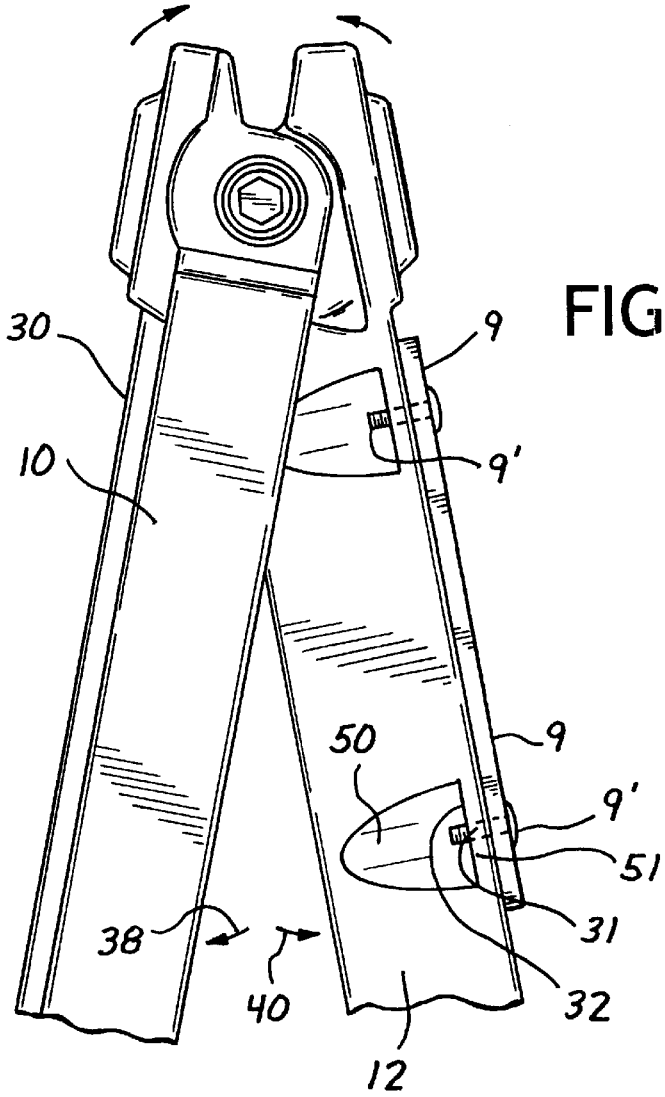
FIG. 6
FIG. 9
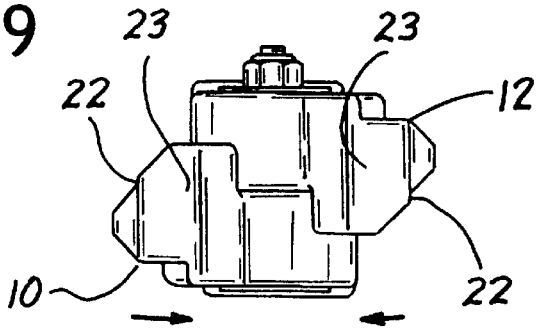

NESTING COLLAPSIBLE BLOW-MOLDED BARRICADE

This application claims the benefit of U.S. Provisional Application No. 60/119,691, filed Feb. 11, 1999.

BACKGROUND OF THE INVENTION

This invention relates to traffic barricades and more particularly to a traffic barricades of the sawhorse variety.

Roads, highways, sidewalks and other areas of vehicular and foot traffic are frequently subject to maintenance and reconstruction activities. Typically, such maintenance interrupts the traffic pattern and requires a detour from normal traffic flow. The principal highway warning device in a construction zone is the traffic barricade. This device typically comprises a horizontal reflective member which has a large face or surface structure to provide immediate visual recognition during both daylight and nighttime hours. This horizontal member is typically supported by two pairs of legs which are attached to form a type of sawhorse configuration.

Originally, such sawhorse traffic delineators were constructed of wood. A horizontal board was mounted to vertically inclined boards in the referenced sawhorse configuration using nuts and bolts. This construction requires a host of parts and labor to assemble the traffic delineator. Such barricades were heavy, costly and difficult to stack. Further these barricades were prone to damaging any vehicle that struck the barricade.

There are a variety of other constructions of sawhorse traffic barricades, all with certain advantages and disadvantages. What is needed then is a durable, lightweight sawhorse barricade of simple construction that can be easily constructed and stored.

SUMMARY OF THE INVENTION

The preferred embodiment of the invention is a traffic barricade comprised of substantially identical legs forming traffic barricade supports that are used to make the traffic barricade. The traffic barricade supports are rotatably joined together at one end of each leg to allow them to pivot. The traffic barricade supports are themselves joined together with one or more rectangular panels and reflective sheeting is applied to the panels, forming the traffic barricade.

Thus, the invention requires only one type of leg, a pivot mechanism and one or more panels to form the traffic barricade.

In the preferred embodiment two identical legs are pivotally attached at one end to form a traffic barricade support. Two or more traffic barricade supports are attached to one side of a rectangular panel to create a traffic barricade. Although in the preferred embodiment the panel is rectangular, any shape presenting a substantially planar surface to the two or more traffic barricade supports may be used as a panel.

The leg has a triangular cross section with a narrow side, a wide side oriented substantially normal to the narrow side and a hypotenuse side. There is a void or hole formed at a first end of the leg to create a bore through the wide side and the hypotenuse side through which a pivot may be fitted. The second end of the leg is designed to contact the surface supporting the traffic barricade support.

In the preferred embodiment the legs are hollow and made of blow-molded plastic for durability, economy and lightness. In an alternative construction, for example, the legs may be made of roto-molded plastic, metal, and they may be solid or hollow.

The pivot may be a bolt, a cylinder or other suitable member to allow two legs to be pivotally hat attached so that they may rotate between a closed position, with the legs substantially parallel, to an open position where the legs are relatively oriented at an angle. In the preferred embodiment a zinc-plated steel cylinder is used.

The two identical legs of a traffic barricade support are pivotally attached at their first ends in relatively opposite orientation, so that the hypotenuse sides of the two legs face each other. In this manner one leg may nest inside the other in the closed position and the traffic barrier support more compactly folds together.

The maximum angle that the two legs of a traffic barricade support can be opened in the open position is limited by a stop extending outwardly from the first end of the narrow side of each leg. Each stop has a contact surface that, when a first leg is pivotally attached to a second leg, engage to prevent further opening of the traffic barricade support at a predetermined maximum angle. The second end of the leg is beveled so that when the predetermined maximum angle of the traffic barrier support has been reached, the second end is substantially parallel to the ground or other supporting surface. Additionally, the triangular cross section of each leg allows a greater sectional modulus because the area of the cross section of the leg is maximized.

In order to facilitate the stacking of traffic barricades, in the preferred embodiment the narrow side of each leg is formed to have a convexly curved surface first portion and a second portion that is a concavely curved surface. The concavely curved surface and the convexly curved surface are complementary in size and shape.

The convex and concave portions formed on the narrow side of the leg allow traffic barricades made from such legs to be securely stacked. The traffic barricades are stacked in alternating opposite orientations so that the convex portions of the legs of one traffic barrier will fit closely within the concave portions of another traffic barrier. In this manner traffic barriers formed from these legs stack securely and will be less likely to shift or slide in a stack of traffic barriers.

Although these two portions may be of any suitable shape, they are preferably rectangular in shape and formed on opposite ends of the narrow side of the leg. Reflective sheeting may be applied to the panel to make the traffic barricade more visible to drivers.

Additional aspects and advantages of the present invention are set forth in the following description and claims, particularly when considered in conjunction with the accompanying drawings in which like parts bear like reference numerals.

BRIEF DESCRIPTION OF THE DRAWINGS

FIGS. 4*a* and 4*b* are detail views of the cylinder pivot, FIG. 4*b* is a side cutaway view.

FIG. 5 is a side view of a traffic barricade support with the legs in the closed position, FIG. 5*a* is a bottom view of 5.

FIG. 6 is a side view of a traffic barricade support with the legs shown in a partially open position.

FIG. 9 is a top view of a traffic barricade support in the closed position.

DETAILED DESCRIPTION OF THE INVENTION

Figure 1:
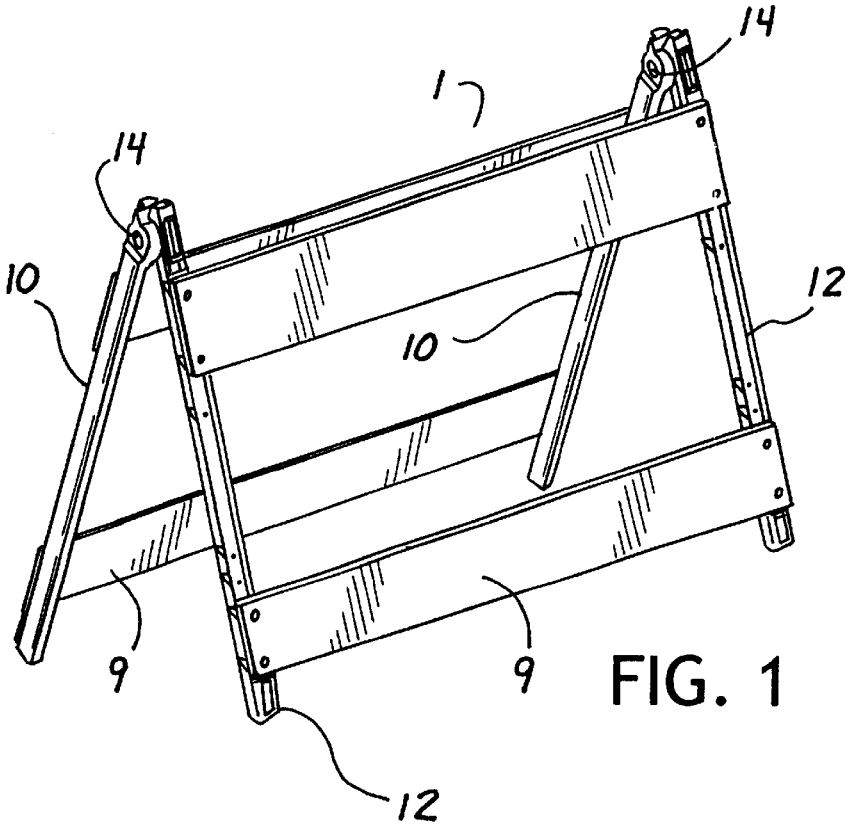
FIG. 1 is a perspective view of a traffic barricade.

FIG. 1 shows a traffic barricade 1 made of two sets of legs 10 and 12 joined together with panels 9. Each set of two legs with a pivot is collectively referred herein to as a traffic barricade support. The legs of each traffic barricade support are joined by a pivoting mechanism 14, hereinafter termed a pivot, and in the preferred embodiment the pivot is a cylinder made of steel. The pivot 14 may be made of metal and or other materials, such as plastic or composite materials. Both legs 10 and 12 are of the same construction, therefore only a single leg design is needed for all the legs of the traffic barricade, with the same design of leg being used for each of the four legs. Other embodiments of the invention may have different but substantially identical leg designs from the preferred embodiment.

Figure 2A:
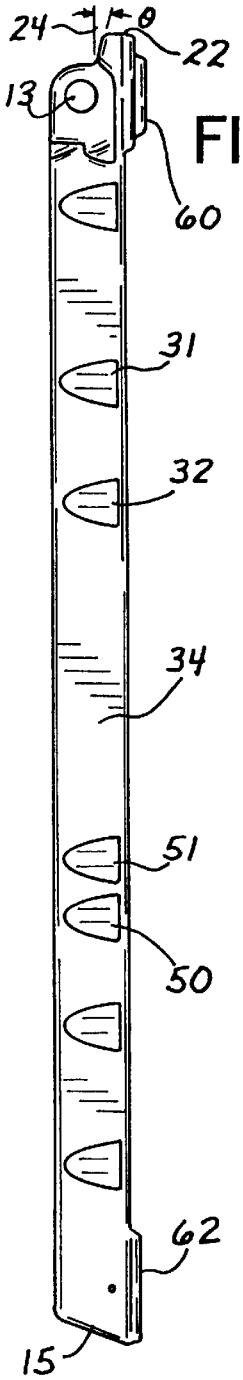
FIGS. 2*a*, 2*b*, 2*c* and 2*d* are four side views of the leg of the traffic barricade.
Figure 2B:
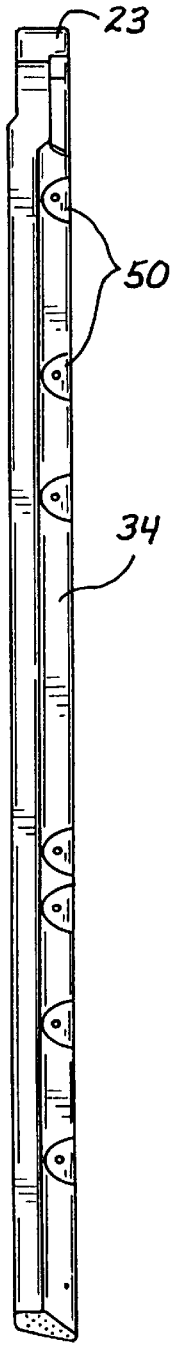
Figure 2C:
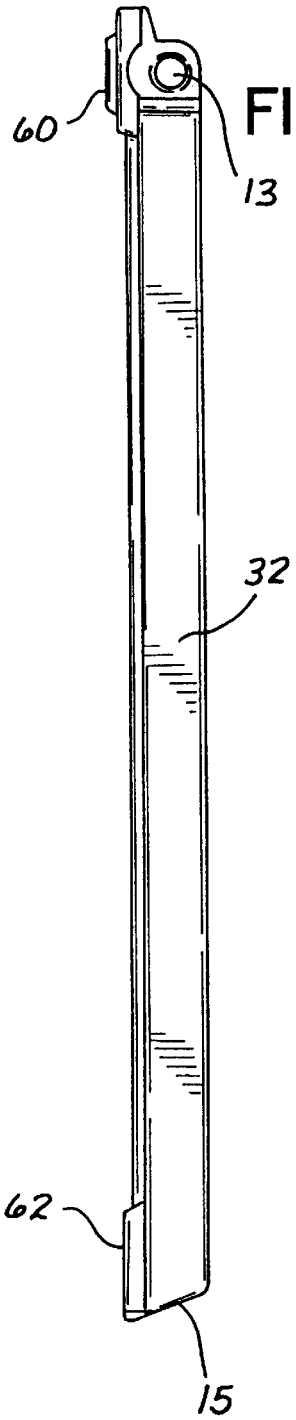
Figure 2D:
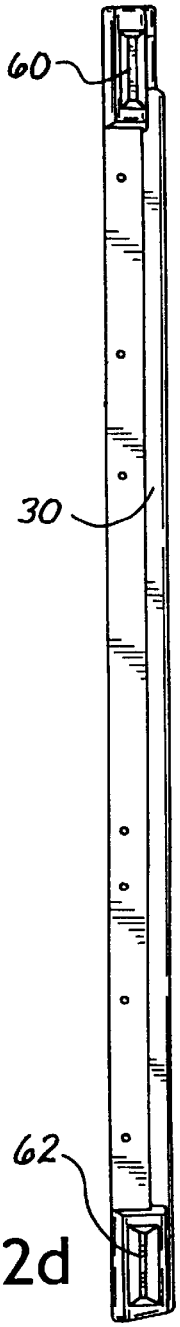
Figure 11:
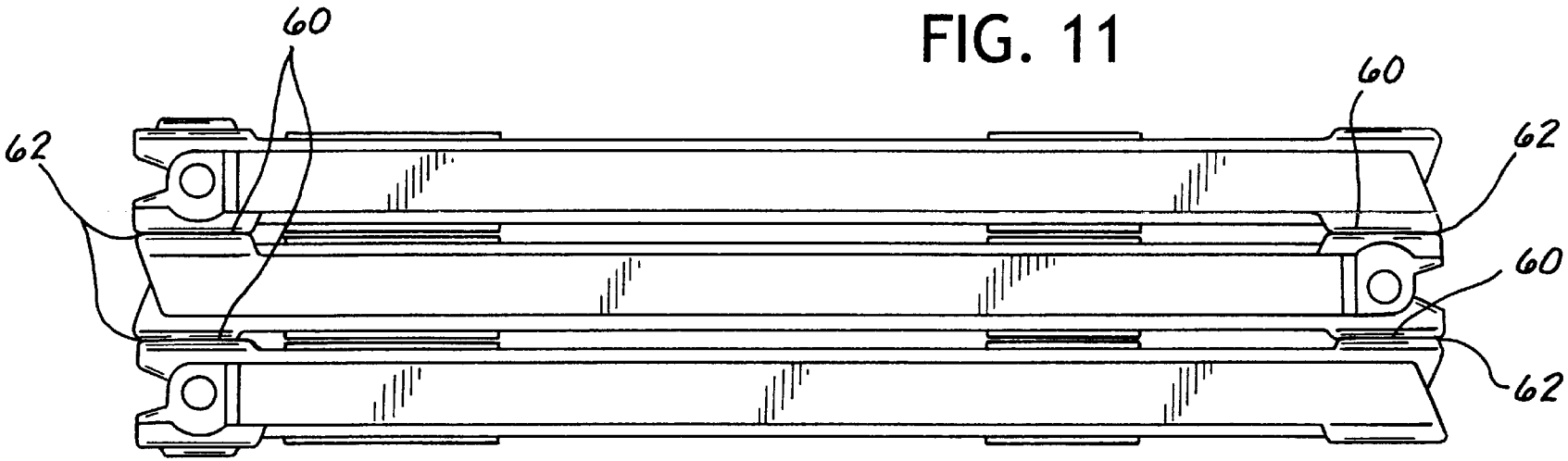
FIG. 11 is side view of stacked traffic barricades.

FIGS. 2*a*–2*d* shows an individual leg from four side views. FIG. 2*a* shows the leg from the hypotenuse side 34. The end of the leg 15 is beveled to allow it to stand parallel or flush to a supporting surface when it is functioning as leg of a traffic barrier. Recesses 50 are shown which allow a screw to recede when it is used to affix a panel. In this view, the recesses 50 are shown with the walls 51 between the flat surface 32 of the recess and the narrow leg side 30 (shown at 2*d*). There is a panel hole 31 that corresponds to the center of recess flat surface 32 through which a panel mounting screw is fitted. Stop 22 is shown that forms a stop contact surface 23. The stop contact surface 23 forms an angle theta with the major axis 24 of each leg. The face of the contact surface 23 can be seen in FIG. 2*b*. FIGS. 2*a* and 2*c* show hole 13 that creates a bore from hypotenuse side 34 through wide side 32. FIGS. 2*a*, 2*c* and 2*d* show convexly curved surface 60 at the first end of the leg and concavely curved surface 62 at the second end. When the legs are assembled into the traffic barricade of FIG. 1, a plurality of traffic barricades may be securely stacked because the convexly curved surface 60 fits into the concavely curved surface 62, as shown in FIG. 11.

Any suitable plastic may be used to manufacture the legs. In a preferred embodiment of the invention, the plastic is high density polyethylene with a density of 0.96. Blow molding is the preferred method of manufacturing the both because it produces a strong barricade leg and also because it is more economical to use this method.

Figure 3:
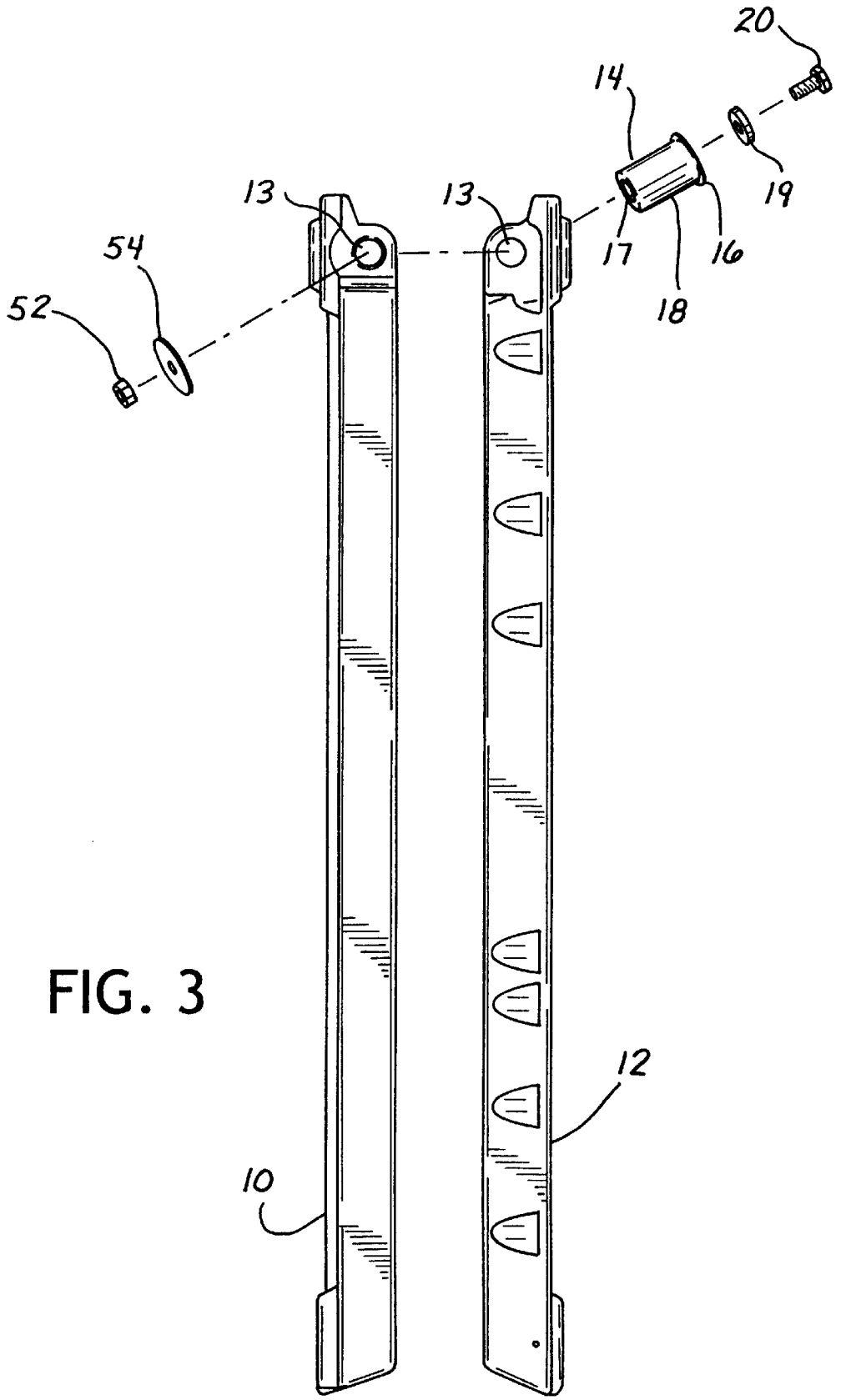
FIG. 3 is an exploded view of the two legs of a traffic barricade support and their pivoting mechanism.

FIG. 3 is an exploded view showing the pivot mechanism 14 of the preferred embodiment as it fits into legs 10 and 12 to make a traffic barricade support. Pivot mechanism 14 is comprised of a cylinder 18 having a flange 16, an end cap 19 and bolt 20, and a nut 52 that is used in conjunction with the bolt 20 shown in the end cap washer 54.

When the pivot is assembled, the cylinder 18 extends through the holes 13 of legs 10 and 12. At the end of the cylinder distal the flange, there is a narrowing or constriction 17, also shown in the cutaway side view 4*b,* formed to retain end cap 19 within the cylinder. The end cap washer 54 has an inner surface that is disposed against the constriction 17 and the outside surface of leg 10 around hole 13 and the bolt 20 is affixed to nut 52 and is disposed against the outside surface of the end cap washer. Nut 52 is disposed against the inside surface of the end cap 19 within the cylinder. This configuration is preferred but not essential, the nut and bolt could be installed in the opposite direction with the bolt disposed against the inside surface of the end cap.

When assembled, the flange and the washer maintain the two legs and the distance between the flange 16 and washer 54 is such that the legs 10 and 12 can freely pivot.

FIGS. 4*a* and 4*b* show the detail of the pivot mechanism, also termed the pivot. Pivot 14 is shown with a flange 16 radially extending from a proximate end of a cylinder 18. At the end of the cylinder distal the flange, there is a narrowing or constriction 17, shown in the cutaway side view 4*b*, formed to retain end cap 19 within the cylinder. The cylinder 18 extends from the flange 16 and through the top first ends of the legs 10 and 12 (not shown). The bolt 20 is mounted through the end cap of the mechanism and extends distally from the flange 16. The end cap 19 of the cylinder 18 is shown to the left and the flange 16 of the cylinder 18 is shown to the right. Note that the end cap 19 and the flange 16 are located at opposite ends of the cylinder 18. Other embodiments of the invention may have other ways of attaching the flange and the end cap to the cylinder or the parts may be unitary. Other embodiments of the invention may have other pivots also.

Now referring to FIG. 5, the two legs 10 and 12 are shown in the closed position nesting together. FIG. 5*a* is a bottom view of the invention in this position. As shown each leg has an approximately triangular cross section. It is to understood that the use of the terms triangular and hypotenuse in this patent are not to be strictly construed as a hypotenuse of a true right triangle, this is simply the closest geometric shape that is useful to describe the structure of the present invention. For example, as FIG. 5*a* shows the cross section of a leg is not a true triangle, but of general triangular shape. What is essential that the cross section of a leg includes a diagonal side, herein referred to as the hypotenuse, so that the hypotenuse sides of two legs will engage in the closed position and thereby nest together. In the preferred embodiment, for example, each leg includes a narrow trim side 25 sized to increase the overall width of a leg to allow sufficient mass of plastic to be used to support a particular traffic barricade and to form a hole of sufficient depth to support the flange. The appropriate additional width of the leg accorded by the trim side is a function of the material used to construct the leg and will be apparent to one of ordinary skill in the art.

In the preferred embodiment the surface of the leg that actually contacts the supporting surface is formed with an irregular surface, such as small bumps 27 to increase the traction of the leg on the surface.

The perimeter of the leg cross section of 5*a* also has two sides, narrow side 30 and wide side 32 oriented at a right angle relative to each other. The narrow side 30 is narrower than wide side 32. The perimeter of the leg cross section also has a hypotenuse 34 extending between the two sides 30 and 32, in the preferred embodiment connected by trim side 25.

When the legs 10 and 12 are closed, as shown, the hypotenuses 34 of each legs align and engage, thus nesting the legs.

Now referring to FIG. 6, the legs 10 and 12 are shown in a partially open position. The legs 10 and 12 have partially opened up in a direction 38 and 40, respectively. The directions 38 and 40 are mutually opposing, shown by arrows, and the directions are also normal to the narrow side 30 of the respective leg.

Attachment of a panel to the legs is straightforward. In this view, the recesses 50 are shown with the walls 51 between the flat surface of the recess and the narrow leg side 30. The panel 9 is affixed, for example, with panel mounting screws or bolts 9' that extend through panel hole 31 that corresponds to the center of recess flat surface 32 through which a panel mounting screw is fitted. Screws or bolts 9' used to mount the panels remain sufficiently in the recess such that they do not to interfere with the nesting of the legs in the closed position.

Figure 7:
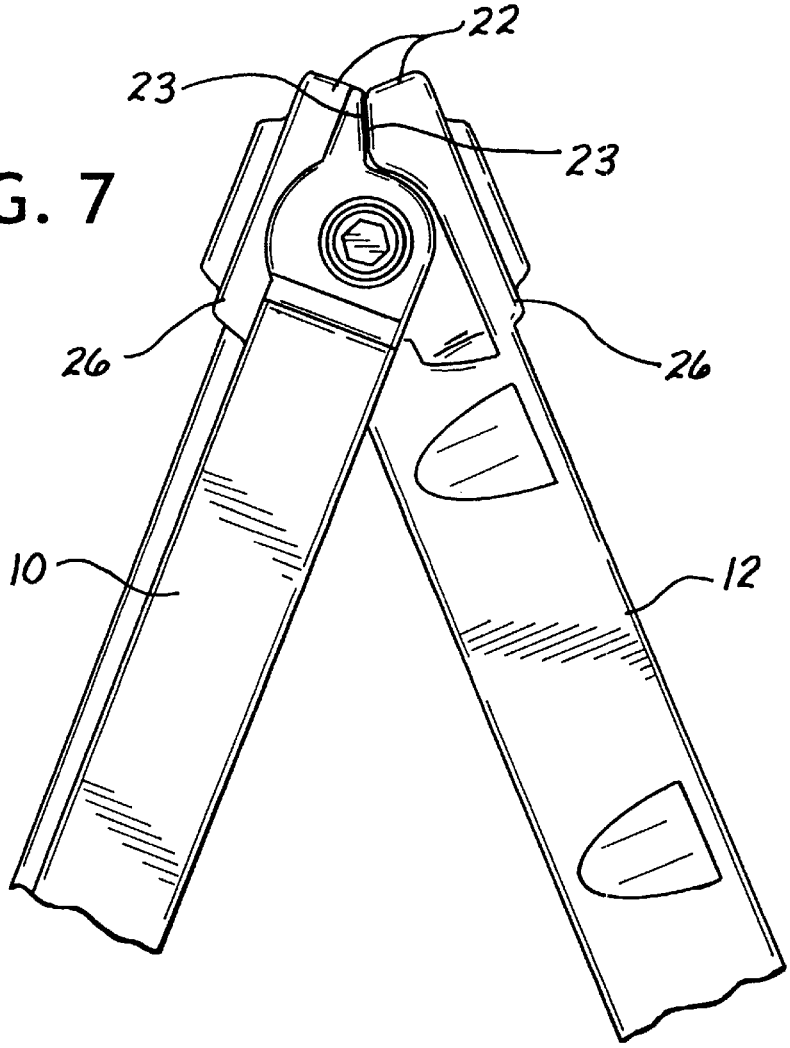
FIG. 7 is a side view of a traffic barricade support with the legs shown in the open position.

The legs 10 and 12 of FIG. 7 are shown in the open position. At the top first ends of the legs 10 and 12 are stops 22. The stops 22 have contact surfaces 23 which are shown engaged in mutual contact. Notice that the stops 22 have reinforcing construction 26 in order to improve the strength of the device.

Figure 8:
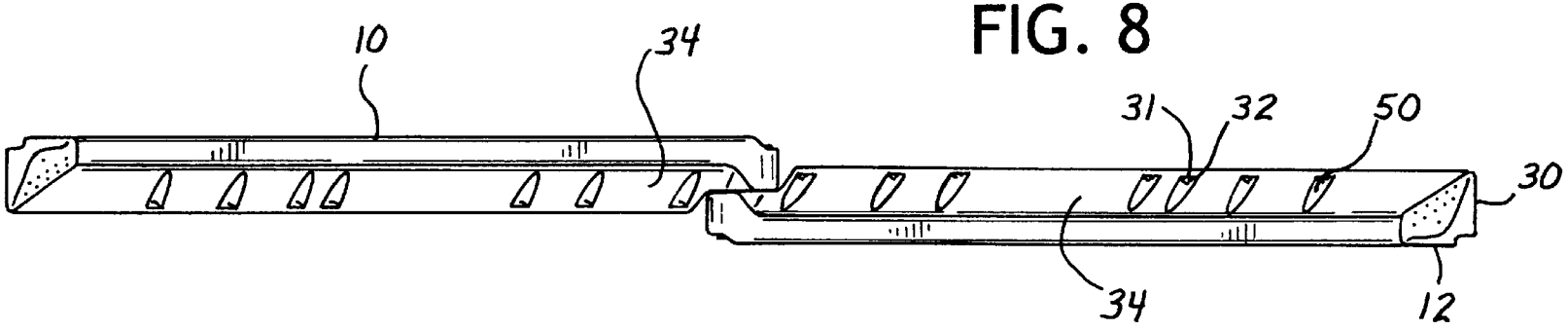
FIG. 8 is a bottom perspective view of a traffic barricade support in a partially open position.

FIG. 8 shows the legs 10 and 12 fully opened and the view is looking up from the bottom of the legs towards the pivoting point. The interior, hypotenuse side 34 of the legs are shown with recesses 50. The recesses 50 are arranged to accommodate a screw, bolt or other attaching device that is used to mount a panel to the legs. The recess 50 has a flat surface 32 that opposes the narrow leg side 30 and a bolt extends through the wall between the recess flat surface and the narrow leg side. The narrow leg side 30 has a panel hole 31 that corresponds to the center of the recess flat surface 32 through which a panel mounting screw is fitted.

FIG. 9 shows the legs 10 and 12 looking down from the top while the legs are in a closed position. As shown the stops 22 are not in contact because the legs are in the closed position, the contact surfaces 23 of the stops are exposed.

Figure 10:
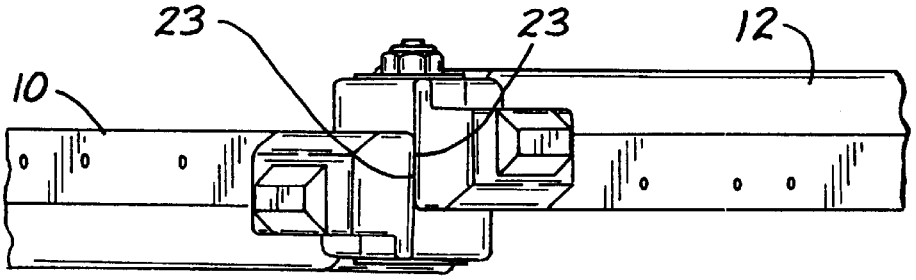
FIG. 10 is a top view of a traffic barricade support in the open position.

Now referring to FIG. 10, legs 10 and 12 are shown in a top view in an open position. Note that the contact surfaces 23 of the two stops 22 extending from the top of the legs are now in contact.

FIG. 11 shows the assembled barricades stacked together. The individual traffic barricades stack secure because the convexly curved surface 60 of one leg stacks neatly into the concavely curved surface 62 of the legs of the traffic barrier stacked on top of it and underneath it. They may stacked one atop another in alternating orientation with the convex portion of one leg fitting in the complementary concave surface portion another traffic barricade.

Figure 12:
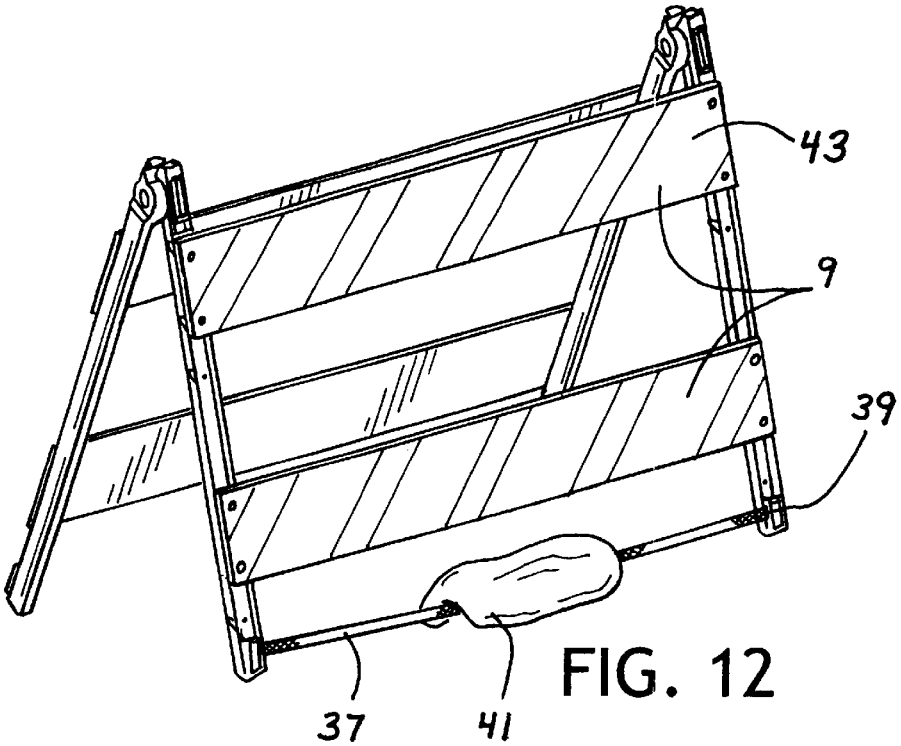
FIG. 12 is a perspective view of a traffic barricade.

FIG. 12 shows the use of a batten 37 to ballast a traffic barricade. Slits 39 may be cut in the legs of two hollow traffic barrier supports forming a traffic barricade to receive a batten, which may be a length of plastic. A sandbag 41 or other available ballasting object may then be placed on the batten to ballast the traffic barricade from being moved by the force of wind or rain. FIG. 12 also shows the use of reflective sheeting 43 applied to the exterior face of panels 9 to increase the visibility of the traffic barricade.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. A traffic barricade support, comprising:

a first leg having a first end and a second end, the leg having a triangular cross section including a narrow side, a wide side oriented substantially normal to the narrow side, and a hypotenuse side, and further forming a void creating a bore through the wide side and the hypotenuse side at the first end;

said first leg having a stop extending outwardly from the first end of the narrow side and having a contact surface;

a second leg substantially identical to the first;

a pivot, passing through the bore of the first leg and the bore of the second leg that pivotally joins the first leg to the second leg so that the hypotenuse side of the first leg is oriented towards the hypotenuse side of the second leg;

whereby when the first leg is pivotally moved from a closed position, where the first leg and the second leg are substantially parallel, to an open position, where the first leg and the second leg are at a relative angle, the stop of the first leg will engage the stop of the second leg and prevent any further increase of the relative angle of the first leg and the second leg.

2. The traffic barricade support of claim 1, whereby when the traffic barricade support is moved from the open position to the closed position, the hypotenuse side of the first leg substantially nests in the hypotenuse side of the second leg.

3. The traffic barricade support of claim 1 wherein the pivot is a bolt.

4. The traffic barricade support of claim 1 wherein the pivot is a cylinder.

5. The traffic barricade support of claim 4, wherein the cylinder is metal.

6. The traffic barricade support of claim 2 wherein the second end of the first leg is beveled to allow the second end of the first leg and the second end of the second leg to be substantially parallel when placed in the open position.

7. The traffic barricade support of claim 2, wherein a first portion of the narrow side of the first leg forms a convexly curved surface and a second portion of the narrow side of the first leg forms a concavely curved surface that is complementary in shape to the convexly curved surface of the first portion.

8. The traffic barricade support of claim 7, wherein the portion that forms a convexly curved surface and the portion that forms a concavely curved surface are located at opposite ends of the narrow side of the first leg.

9. The traffic barricade support of claim 1 wherein the legs are hollow and formed from blow molded plastic.

10. The traffic barricade support of claim 1 wherein the legs are hollow and formed from roto-molded plastic.

11. A traffic barricade, comprising:

a first traffic barricade support, comprising:

a first leg having a first end and a second end, the leg having a triangular cross section including a narrow side, a wide side oriented substantially normally to the narrow side and a hypotenuse side and further forming a void creating a bore through the wide side and the hypotenuse side at the first end;

said first leg having a stop extending outwardly from the first end of the narrow side and having a contact surface;

a second leg substantially identical to the first; and a pivot, passing through the bore of the first leg and the bore of the second leg that pivotally joins the first leg to the second leg so that the hypotenuse side of the first leg is oriented towards the hypotenuse side of the second leg, whereby when the first leg is pivotally removed from a closed position, where the first leg and the second leg are substantially parallel, to an open position, where the first leg and the second leg are at a relative angle, the stop of the first leg engages the stop of the second leg and prevents any further increase in the relative angle of the first leg and the second leg;

a second traffic barricade support, substantially identical to the first traffic barricade support; and a panel, wherein the narrow side of a leg of the first traffic barricade support and the narrow side of a leg of the second traffic barricade support are attached to the same side of the panel.

12. The traffic barricade of claim 11, whereby when the traffic barricade supports are moved from the open position to the closed position, the hypotenuse side of the first leg of the first traffic barricade support substantially nests in the hypotenuse side of the second leg of the first traffic barricade support and the first leg of the second traffic barricade support substantially nests in the hypotenuse side of the second leg of the second traffic barricade support.

13. The traffic barricade of claim 11 wherein the pivot is a bolt.

14. The traffic barricade of claim 11 wherein the pivot is a cylinder.

15. The traffic barricade of claim 14, wherein the cylinder is metal.

16. The traffic barricade of claim 12 wherein the second end of the first leg is beveled to allow the footing side of all of the legs to be parallel when placed in the open position.

17. The traffic barricade of claim 12 wherein a first portion of the narrow side of the first leg forms a convexly curved surface and a second portion of the narrow side of the first leg forms a concavely curved surface that is complementary in shape to the convexly curved surface of the first portion.

18. The traffic barricade of claim 17 wherein the portion that is a convexly curved surface and the portion that is a concavely curved surface are located at opposite ends of the narrow side of first leg.

19. The traffic barricade of claim 11 wherein the legs are hollow and formed from blow molded plastic.

20. The traffic barricade of claim 11 wherein the legs are hollow and formed from roto-molded plastic.

21. The traffic barricade of claim 11, wherein one side of the panel is covered with reflective sheeting.

22. A method for stacking traffic barricades, comprising the steps of:

a) orienting a first traffic barricade in a substantially horizontal position on a surface, said barricade comprising:

a first barricade support including a first leg having a first end and a second end, the leg having a triangular cross section including a narrow side, a wide side oriented substantially normally to the narrow side and a hypotenuse side and further forming a void creating a bore through the wide side and the hypotenuse side at the first end;

said first leg having a stop extending outwardly from the first end of the narrow side and having a contact surface;

a second leg substantially identical to the first;

a pivot, passing through the bore of the first leg and the bore of the second leg that pivotally joins the first leg to the second leg so that the hypotenuse side of the first leg is oriented towards the hypotenuse side of the second leg, whereby when the first leg is pivotally moved from a closed position, wherein the first leg and the second leg are substantially parallel, to an open position, wherein the first leg and the second leg are at a relative angle, the stop of the first leg engages the stop of the second leg and prevents any further increase in the relative angle of the first leg and the second leg;

a second traffic barricade support, substantially identical to the first traffic barricade support, and a panel, wherein the narrow side of a leg of the first traffic barricade support and the narrow side of a leg of the second traffic barricade support are attached to the same side of the panel; and wherein a first portion of The narrow side of the first leg forms a convexly curved surface and a second portion of the narrow side of the first leg forms a concavely curved surface that is complementary in shape to the convexly curved surface of the first portion; and b) placing a second traffic barricade substantially identical to the first traffic barricade on top of the first traffic barricade, such that at least one of the convexly curved surfaces of The second traffic barricade nests in at least one of the at least one of the concavely curved surfaces of the first traffic barricade.

* * * * *